US010661870B2

(12) United States Patent
Cameron et al.

(10) Patent No.: US 10,661,870 B2
(45) Date of Patent: May 26, 2020

(54) AERODYNAMIC ROWING OARS

(71) Applicant: The Boeing Company, Chicago, IL (US)

(72) Inventors: Allan J. Cameron, Fountain Valley, CA (US); Robert D. Gregg, III, Mukilteo, WA (US); James Long-Lerno, Anaheim, CA (US)

(73) Assignee: The Boeing Company, Chicago, IL (US)

( * ) Notice: Subject to any disclaimer, the term of this patent is extended or adjusted under 35 U.S.C. 154(b) by 0 days.

(21) Appl. No.: 15/934,354

(22) Filed: Mar. 23, 2018

(65) Prior Publication Data

US 2019/0291836 A1 Sep. 26, 2019

(51) Int. Cl.

| | |
|---|---|
| ***B63H 16/04*** | (2006.01) |
| ***F15D 1/12*** | (2006.01) |
| ***F15D 1/00*** | (2006.01) |

(52) U.S. Cl.

CPC ..... *B63H 16/04* (2013.01); *F15D 1/003* (2013.01); *F15D 1/12* (2013.01)

(58) Field of Classification Search

CPC ..... B63H 16/04; F15D 1/003; F15D 1/12
See application file for complete search history.

(56) References Cited

U.S. PATENT DOCUMENTS

| | | | | |
|---|---|---|---|---|
| 6,126,500 | A * | 10/2000 | Bell | B63H 16/04 440/101 |
| 2001/0041629 | A1* | 11/2001 | Hirata | A01K 87/00 473/316 |
| 2006/0014588 | A1* | 1/2006 | Page | A63B 53/10 473/228 |
| 2006/0216476 | A1* | 9/2006 | Ganti | C23C 18/02 428/143 |
| 2013/0079172 | A1* | 3/2013 | Roger | A63B 53/10 473/228 |
| 2013/0212767 | A1* | 8/2013 | Nordstom | A41D 13/0015 2/69 |
| 2015/0366281 | A1* | 12/2015 | Miller | B32B 27/12 428/136 |

OTHER PUBLICATIONS

Kuyt, C.B. et al., "Drag reduction by applying speedstrips on rowing oars", Procedia Engineering 147; 11th conference of the International Sports Engineering Association, 2016, pp. 110-115.

* cited by examiner

*Primary Examiner* — Anthony D Wiest
(74) *Attorney, Agent, or Firm* — Kwan & Olynick LLP

(57) ABSTRACT

A rowing oar is described. The rowing oar can have a plurality of flow disrupters arranged on a shaft of the oar. In one embodiment, the flow disrupters can be circular bumps arranged in lines along the shaft of the oar. The flow disrupters can cause the air flow over the oar to be more turbulent so that the flow separation on a backside of the oar is reduced. The reduction in flow separation can reduce aerodynamic drag on the oar when it travels through the air. Thus, a rower can expend less energy during rowing using the oar.

22 Claims, 6 Drawing Sheets

AERODYNAMIC ROWING OARS

TECHNICAL FIELD

This disclosure generally relates to rowing oars. More specifically, this disclosure relates to rowing oars including flow disrupters disposed along a shaft of the oar to reduce aerodynamic drag on the oar.

BACKGROUND

Sweep rowing or sculling involve a rower or teams of rowers using a single oar or a pair of oars. In sweep rowing, a rower handles a single oar with two hands. Whereas, in sculling, a rower handles a pair of oars, one in each hand. In sweep rowing competitions, teams of two, four or eight rowers typically compete against one another. In sculling competitions, one, two, four or eight persons typically compete against one another.

During a rowing stroke, the oar alternates between being in the water and traveling through the air. While the oar is in the air, the oar experiences aerodynamic drag which must be overcome by the rower each time the oar is returned for its next trip through the water. In view of the above, oars with a better aerodynamic performance are desired.

SUMMARY

Rowing oars are described. The rowing oars can be used in sweep rowing where a rower handles a single oar and sculling where a rower handles two oars. During a rowing stroke, an oar spends a portion of the time in the water (drive phase) and a portion of the time in the air (recovery phase). To reduce the energy expended by the rower, the rowing oars can include features which reduce aerodynamic drag when the oar travels through the air during the recovery phase.

One aspect of the invention can be related to a rowing oar. The rowing oar can be generally characterized as including 1) a blade and 2) a shaft. The shaft can include a plurality of flow disrupters arranged around a perimeter of the shaft configured to reduce the aerodynamic drag on the oar at least during a recovery phase of a rowing stroke.

The perimeter of the shaft can include a first half and a second half where the plurality of flow disrupters can be disposed around the first half of the perimeter. In one embodiment, the plurality of flow disrupters can be integrally formed with the shaft. In another embodiment, the shaft and the plurality of flow disrupters can be formed separately. For example, the shaft can be formed and then, the plurality of flow disrupters can be bonded to the shaft.

In particular embodiments, the plurality of flow disrupters can be bumps. The plurality of bumps can have a height between 0.25 and 1.5 mm. A cross section of the bumps can be circular. Although, other shapes can be utilized.

A maximum diameter of the bumps can be between three and fifteen mm. In one embodiment, the bumps can be arranged in one or more lines along a surface of the shaft. A spacing between the bumps in the one or more lines can be between three mm and fifteen mm. In some embodiments, the bumps can be integrally formed with the shaft. In other embodiments, the bumps can be formed on a tape, which is bonded to the shaft after the shaft is formed.

In one embodiment, the cross section of the shaft can be circular. However, the shaft can be formed in other shapes. On the circular shaft, the bumps can be arranged in a first line, a second line, a third line and a fourth line along a length of the shaft. In one embodiment, a first angle between the first line and the second line can be thirty degrees, a second angle between the second line and the third line can be one hundred twenty degrees and a third angle between the third line and the fourth line can be thirty degrees.

A length of oar traveling over the water can be between two hundred to four hundred centimeters. When a cross section of the oar is circular, a diameter of the shaft of the oar can be between two and seven centimeters. The shaft can be tapered such that the diameter varies along the shaft. In one embodiment, the shaft of the oar can formed from a carbon composite material or from fiberglass.

In alternate embodiments, the plurality of flow disrupters can be formed as a set of ridges. The set of ridges can be arranged in an alternating line direction pattern. In another embodiment, the plurality of flow disrupters can be conformal vortex generators.

Another aspect of the invention can be generally characterized as a rowing system. The rowing system can be generally characterized as including: 1) a boat and 2) a plurality of oars. The plurality of oars can each include a i) blade and ii) a shaft. The shaft can include a plurality of flow disrupters arranged around a perimeter of the shaft configured to reduce the aerodynamic drag on the oar at least during a recovery phase of a rowing stroke and a mechanism for coupling each of the plurality of oars to the boat.

In one embodiment, the oar can be a sweep oar configured to be gripped with two hands. In another embodiment, the oar can be a scull oar configured to be gripped with a single hand. The boat can include seats for one, two, four, six or eight persons.

An aspect of the present invention can be related to a method of assembling an oar. The method can be generally characterized as comprising: 1) determining oar parameters including a shape and size of the oar, 2) determining a drag reduction pattern including a plurality of flow disrupters and 3) forming an oar with the plurality flow disrupters arranged in the drag reduction parameter.

BRIEF DESCRIPTION OF THE DRAWINGS

Having thus described examples of the disclosure in general terms, reference will now be made to the accompanying drawings, which are not necessarily drawn to scale, and wherein like reference characters designate the same or similar parts throughout the several views, and wherein:

FIG. 1A is a top view of a single scull and oars, according to one aspect of the present disclosure.

FIG. 1B is a top view of a double scull and oars, according to one aspect of the present disclosure.

FIG. 1C is a perspective view of a double scull, oars and rowers, according to one aspect of the present disclosure.

FIG. 1D is a top view showing additional scull and sweep rowing configurations, according to aspects of the present disclosure.

FIG. 2 is a view of a single scull showing the boat velocity, oar motion and air velocity over the oar according to one aspect of the present disclosure FIG. 3 is a side view of an oar according to one aspect of the present disclosure.

FIG. 4 is side view and cross sectional view of an oar including flow disrupters arranged in a drag reduction pattern, according to one aspect of the present disclosure.

FIG. 5 is a cross sectional view of an oar including flow disrupters and an airflow pattern over the oar according to aspects of the present disclosure.

FIGS. 6A and 6B are top views of flow disrupters, according aspects of the present disclosure.

FIG. 7 is a method of assembling an oar, according to one aspect of the present disclosure.

DETAILED DESCRIPTION

In the following description, numerous specific details are set forth in order to provide a thorough understanding of the presented concepts. The presented concepts may be practiced without some or all of these specific details. In other instances, well known process operations have not been described in detail so as to not unnecessarily obscure the described concepts. While some concepts will be described in conjunction with the specific examples, it will be understood that these examples are not intended to be limiting.

Reference herein to "one example" or "one aspect" means that one or more feature, structure, or characteristic described in connection with the example or aspect is included in at least one implementation. The phrase "one example" or "one aspect" in various places in the specification may or may not be referring to the same example or aspect.

Introduction

With respect to the following figures rowing systems including oar configurations are discussed. An oar configuration can include a shaft with flow disrupters. The flow disrupters can cause a transition to turbulence when air flow over the shaft. As an example, a cylindrical shaft can include a number of raised surfaces, such as bumps, which cause the flow to transition to a more turbulent state.

The transition to turbulence can delay flow separation over the shaft which can reduce the aerodynamic drag associated with air flow over the shaft. During a recovery phase of a rowing stroke, when the oar is out of the water and travelling through the air, the reduction in aerodynamic drag can reduce the energy that is needed to move the oar through the air, which can provide a competitive advantage to a rower using the oar with the features described herein.

In more detail, with respect to FIGS. 1A, 1B, 1C and 1D a few examples of rowing system configurations are described, such as sweep rowing and scull rowing. With respect to FIG. 2, a single scull, showing the boat velocity, oar motion and air velocity over the oar, is discussed. In regards to FIG. 3, a side view of an oar is described.

Figure 4:
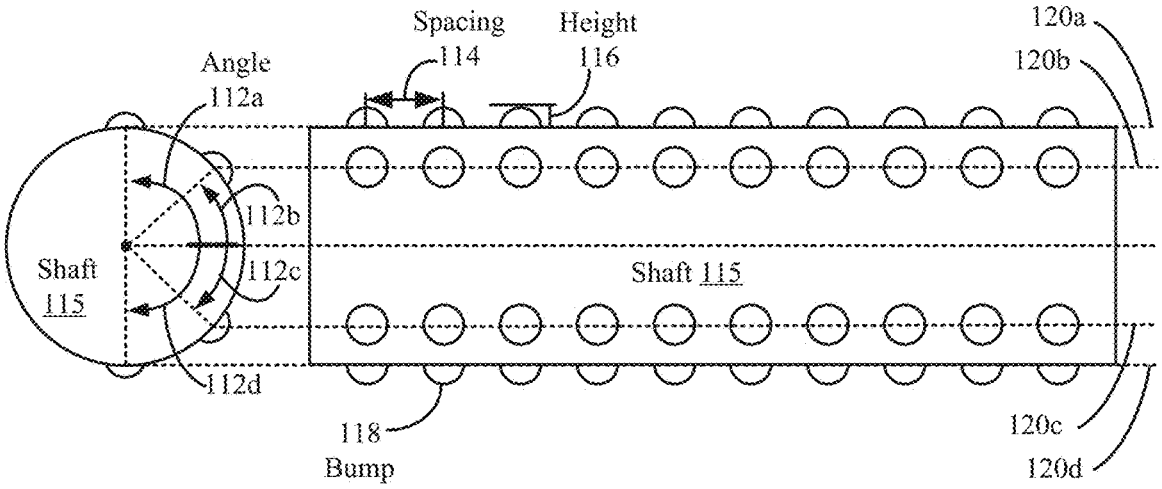

With respect to FIG. 4, a side view and cross sectional view of an oar including flow disrupters arranged in a drag reduction pattern is discussed. With respect to FIG. 5, a cross sectional view of an oar including flow disrupters and an airflow pattern over the oar is described. In particular, flow disrupters formed as bumps and arranged in a drag reduction pattern are discussed. With respect to FIGS. 6A and 6B, top views of flow disrupters, such as raised ridges and ramps for inducing vortices, are described. Finally, in regards to FIG. 7, a method of assembling an oar with flow disrupters arranged in a drag reduction pattern is described.

Figure 1A:
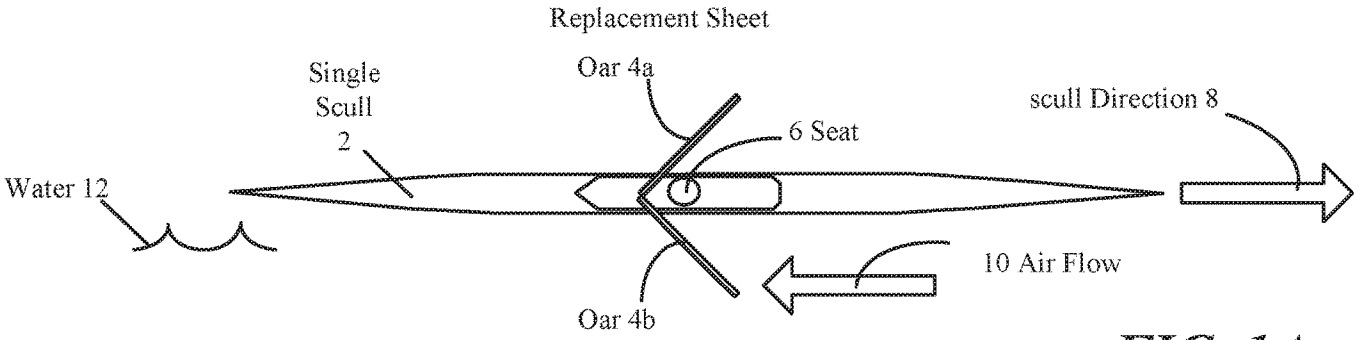

FIG. 1A is a top view of a single scull 2 and oars, 4*a* and 4*b*. A rower seated in seat 6 can row the scull through water 12 using oars 4*a* and 4*b*. For the orientation of the oars shown, the single scull 2 can be propelled in direction 8, which results in air flow over the oars in direction 10.

Figure 1B:
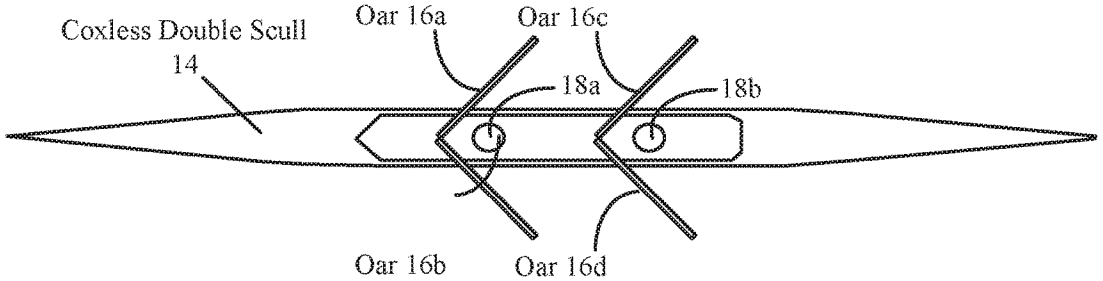

FIG. 1B is a top view of a double scull 14 and oars with oars 16*a*, 16*b*, 16*c* and 16*d*. The scull includes seats, 18*a* and 18*b* for two rowers. In competitive sculling, single person, two person and four person teams can be used. In addition, the teams can include a non-rowing coxswain in the two and four person boats.

In a sweep configuration, each rower at seats 18*a* and 18*b* utilizes a single oar as opposed to two oars. In competitive sweep rowing, teams of two, four and eight rowers can be utilized. The teams can include a non-rowing coxswain in the two and four person boats. In competitive rowing, a coxswain is always included in a boat with eight rowers.

Figure 1C:
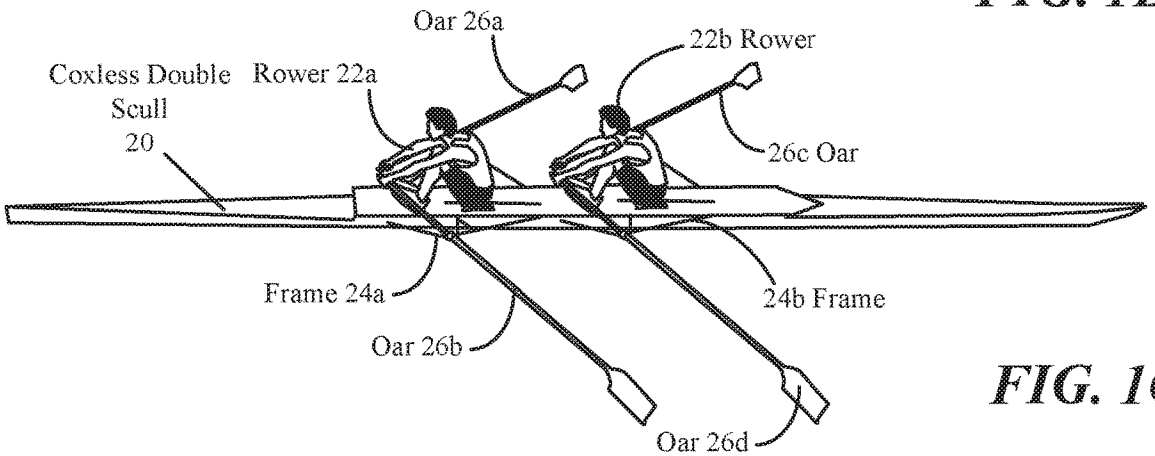

FIG. 1C is a perspective view of a double scull 20, oars, 26*a*, 26*b*, 26*c* and 26*d*, and rowers 22*a* and 22*b*. A sculling configuration is depicted. Thus, rower 22*a* controls two oars, 26*a* and 26*b*. Whereas, rower 22*b* controls two oars, 26*c* and 26*d*.

A rigger, such as rigger 24*a* and 24*b*, can be provided for controlling each oar using an oarlock. The rigger and oarlock secures each oar to the boat. Further, the rigger and oarlock provide a pivot point for the rotation of each oar. The pivot point is held at a fixed position relative to the boat by the frame. As is described below, the oar can travel in arc around the pivot point.

Figure 1D:
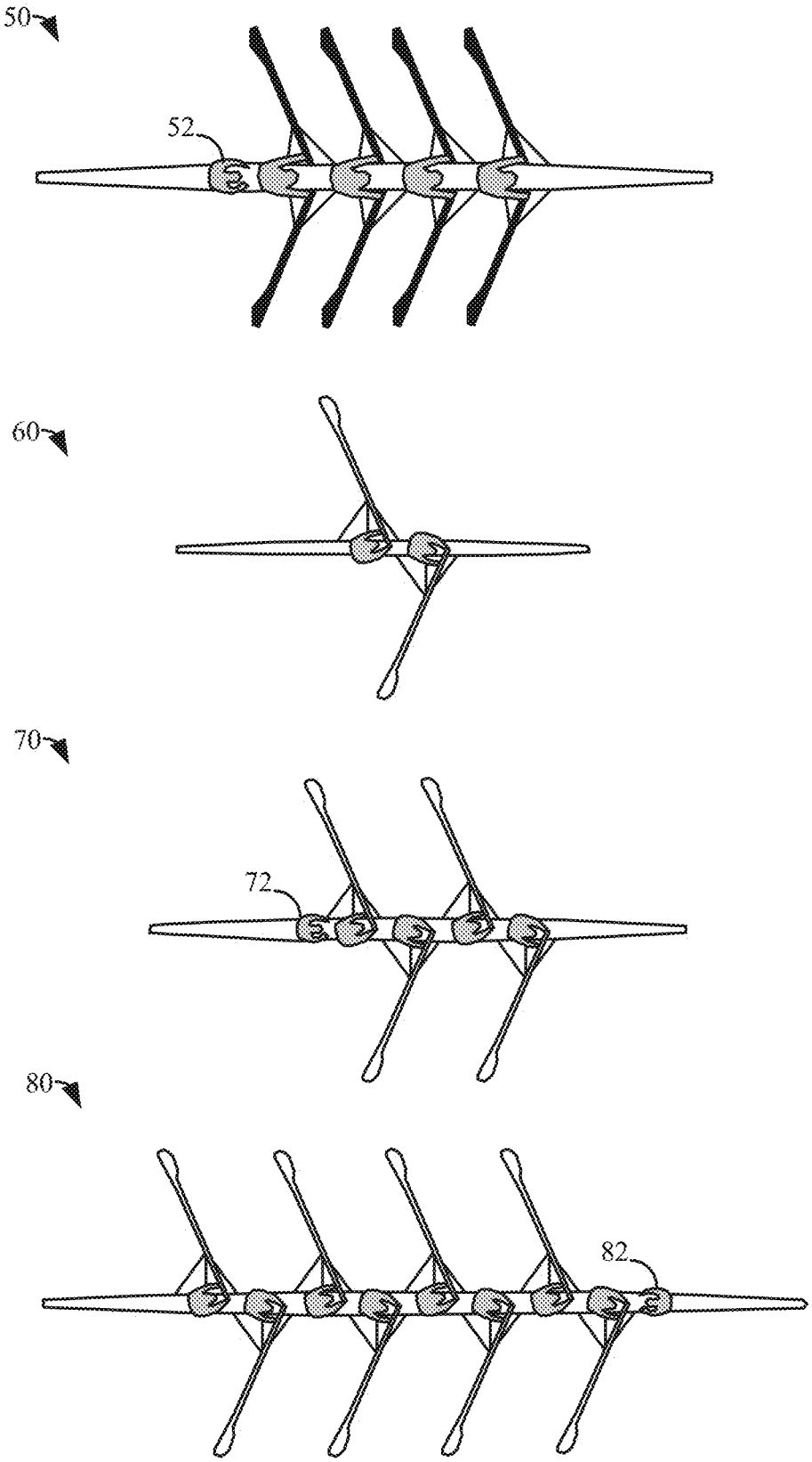

FIG. 1D is a top view showing additional scull and sweep rowing configurations. First, a sculling configuration 50 is shown. The sculling configuration 50 includes four rowers each handling two oars and a coxswain 52. The boat can be about forty two feet long and weigh one hundred fifteen pounds.

Second, a sweep configuration 60 for two people is shown. The sweep configuration 60 includes two rowers each handling a single oar. The boat can be about thirty feet long, thirteen inches wide and weigh about sixty pounds.

Third, a five person sweep configuration 70 is shown. The sweep configuration 60 includes four rowers each handling a single oar and a coxswain 72. The boat can be about forty two feet long, twenty one inches wide and weigh about one hundred twelve pounds.

Finally, a sweep configuration 80 for nine people is shown. The sweep configuration 80 includes eight rowers each handling a single oar and a coxswain 82. The boat can be about sixty feet long, twenty six inches wide and weigh about two hundred ten pounds.

Figure 2:
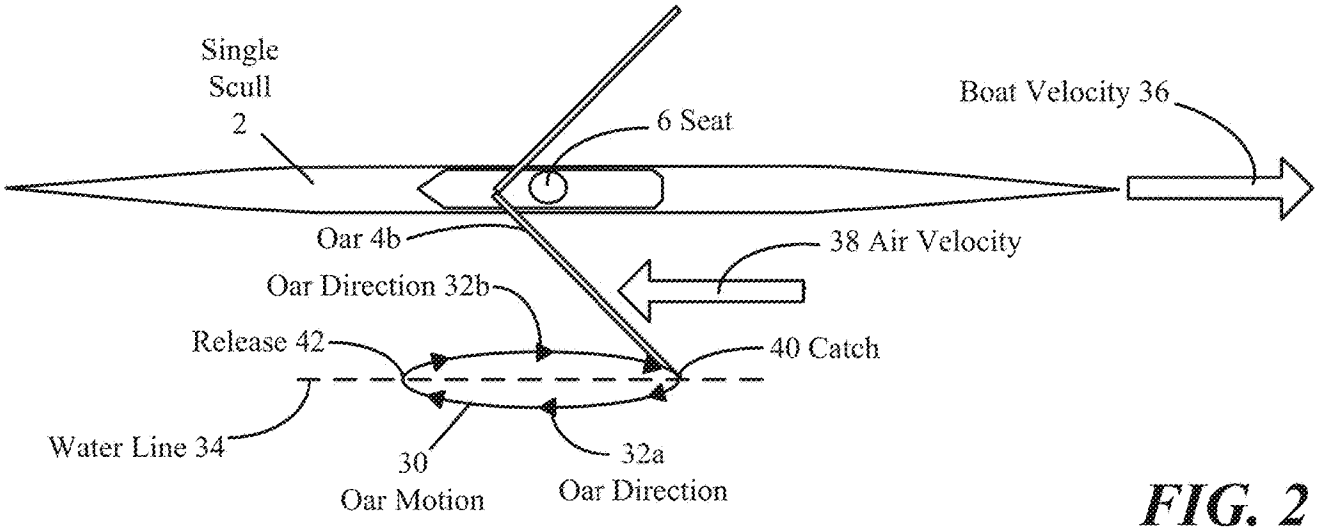

FIG. 2 is a view of a single scull 2 showing the boat velocity 36, oar motion 30 and air velocity 38 over the oar. The air velocity 38 over the oar 4*b* can depend on the boat velocity 36, a wind velocity (not shown) and a velocity of the oar. The boat velocity 36 contributes a component to the air velocity 38 over the oar 4*b* which is in the opposite direction of the boat velocity 36. The wind velocity can be variable. It can add to or subtract from the air velocity 38.

The oar motion 30 alternates in direction, such as from 32*a* to 32*b*. During the oar motion 30, the oar 4*b* travels under and over the water line 34. The catch 40 refers to the placement of the oar blade in the water. The release 42 refers to the when the rower removes the oar blade from the water. The action between catch and release is the first phase of the stroke in the oar motion 30 that propels the boat.

At the catch 40 the rower places the blade in the water (catch) and applies pressure to the oar by pushing the seat 6 toward the bow of the single scull 2 by extending the legs, thus pushing the boat through the water. The oar 4*b* moves in direction 32*a*, which is opposite the boat velocity 36.

The point of placement of the blade in the water can be a relatively fixed point about which the oar 4*b* serves as a lever to propel the boat. As the rower's legs approach full extension, the rower pivots the torso toward the bow of the boat and then finally pulls the arms towards his or her chest. The hands can meet the chest right above the diaphragm. This portion of the stroke can be referred to as the drive phase.

At the end of the drive phase of the stroke, with the blade still in the water, the hands can drop slightly to unload the oar so that spring energy stored in the bend of the oar gets transferred to the boat, which eases removing the oar 4*b* from the water and minimizes energy wasted on lifting water above the surface (splashing).

The recovery phase follows the drive phase. In the recovery phase the oar moves in direction 32*b* which is in the same direction as the boat velocity 36. The recovery starts with the extraction of the oar from the water and involves coordinating the body movements with the goal to move the oar back to the catch 40.

In extraction, the rower can push down on the oar handle to quickly lift the blade from the water (finish) and rapidly rotates the oar so that the blade is parallel to the water. The process of rotating the blade can be referred to as feathering the blade. Feathering the blade can reduce the aerodynamic drag associated with the blade.

Simultaneously, the rower can push the oar handle away from the chest. The blade can emerge from the water square and can be feathered immediately once clear of the water. After feathering and extending the arms, the rower pivots the body forward. Once the hands are past the knees, the rower compresses the legs, which moves the seat towards the stern of the boat. The leg compression occurs relatively slowly compared to the rest of the stroke, which affords the rower a moment to recover, and allows the boat to glide through the water. The gliding of the boat through the water during recovery is often called run.

During the recovery phase, without wind, the air velocity 38 over the oar 4*b* can be the sum of the oar velocity and the air velocity due to the boat velocity 36. The air velocity due to the boat velocity 36 is approximately parallel to the water. The oar velocity varies in direction as the oar can travel in an arc as it moves in direction 32*b*. For, the purposes of discussion, the oar can be generally considered to move parallel to the water.

As an example of the velocities involved, an elite eight man crew can do two thousand meters in about 5.23 minutes which is an average boat speed of about 22.29 km/h. The oars can travel at about a speed 16.74 km/h. This estimation is based upon an average stroke rating of 40/minute with 60% the stroke being out of the water and traveling through the air in an arc of 92 degrees with a radius of 263.5 cm. Thus, the air speed over the oar 4*h*, which is the sum of the oar speed and the boat speed can be 39 km/h. In general, the air speed over the oar 4*b* can be up to 50 km/h. The aerodynamic drag on the oar 4*b* can be proportional to a coefficient of drag of the oar, a characteristic area of the oar and the square of the air speed over the oar 4*b*.

The example values provided above are based upon averages during a two thousand meter race. The boat speed between recovery (oars in the air) vs. drive (oars in the water) can vary. The boat speed is typically greater when the oars are in the air. Thus, the air speed over the oars can be higher during the recovery phase than indicated by the average values. Further, the oars can be shorter or longer, which can affect the average velocity of the oars. Thus, these values are provided for the purposes of illustration only and are not meant to be limiting.

Figure 3:
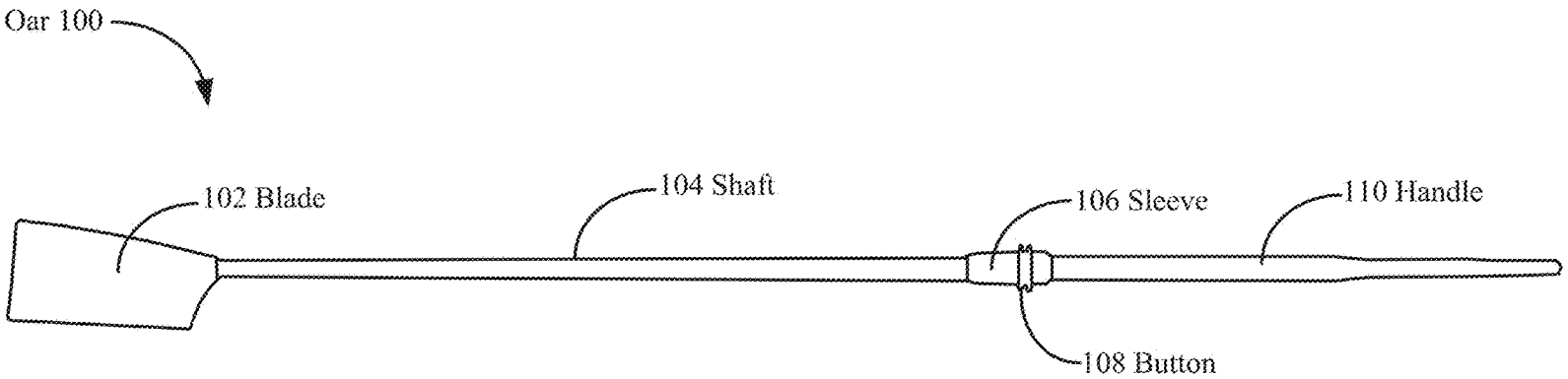

FIG. 3 is a side view of an oar 100. The oar 100 can include a blade 102, a shaft 104, a sleeve 106, a button 108 and a handle 110. The blade 102 can include some curvature, which is not shown. The blade is dipped in the water to propel the boat. The oar 100 can be coupled to a rigger using oarlock and the button 108 and the sleeve 106. The rower can grip the oar at the handle 110.

In particular embodiments, a length of the oar 100 can be between two hundred and four hundred centimeters. The shaft 104 can have a circular cross section with a diameter between two and seven centimeters. Other, non-circular shapes, such as ovular shapes, are possible and a circular shape is provided for the purposes of illustration only.

The shaft 104 can be tapered with a circular diameter that varies between the sleeve 106 and the blade 102. For example, the shaft can be about five cm at the sleeve 106 and 3.8 cm at the blade 102. In another example, the shaft can vary in thickness between about three cm and four cm.

As an example, an oar 100 configured for sweep rowing can have a length of about 375 cm for long range rowing utilized by a male. An overall range can be between about 360 cm and 380 cm. An oar configured scull rowing can have a length of 275 cm for short range scull rowing used by a female. An overall range can be about 275 cm to 295 cm.

In various embodiments, the oar can be formed from carbon fiber, fiber glass or a combination of carbon fiber and fiber glass. Carbon fiber tends to be stronger than fiber glass. Hence, it allows for thinner shaft diameter. However, it is more expensive than fiber glass.

FIG. 4 is side view and cross sectional view of an oar including flow disrupters arranged in a drag reduction pattern. In one embodiment, the flow disrupters can be arranged on a shaft 115 of an oar, i.e., between the blade and the sleeve. The flow disrupters can be configured to cause the flow over the oar to transition to a more turbulent state. This process can be referred to as "tripping" the flow. A transition to the more turbulent state can delay separation of the flow over the oar which can reduce the aerodynamic drag. For example, for flow over a circular oar shaft, where the flow impinges the oar on a front side, the flow can be tripped to delay separation on the backside of the oar to reduce the aerodynamic drag.

In one embodiment, the flow disrupters can be formed as a series of round bumps on the shaft 115 of the oar. The bumps can have a circular cross section. However, other shapes are possible, such as an ovular shape. In particular embodiments, the bumps can have a diameter between three and fifteen millimeters. The spacing 114 between the bumps can be between about three and fifteen millimeters. In one embodiment, the bumps can be about seven millimeters in diameter and have a spacing 114 between the bumps of seven millimeters.

The bumps can have a height 116. The height 116 can vary depending on a diameter of the shaft or general shape of the shaft if the shaft is a non-circular shape. In various embodiments, the height 116 of the bumps can be between 0.25 mm and 1.5 mm. The height 116 of the bumps can be the distance measured perpendicular to the surface of the shaft to the top of the bump. In example above, where bumps with seven millimeter spacing and seven millimeter diameter are used, the bumps can be about one millimeter in height.

In one embodiment, the flow disrupters can be integrally formed with the shaft. For example, the shaft 115 can be formed and then machined to remove material to form a flow disrupter pattern. As another embodiment, an arrangement of flow disrupters, such as a bump pattern, can be built up when the shaft is formed from a material, such as a composite material. In another example, the shaft can be formed and then bump pattern can be injection molded around the shaft.

In other embodiment, the shaft can be formed and then the flow disrupter pattern can be added. For example, a tape with bumps can be applied to the shaft. In another example, a flexible sleeve with a flow disrupter pattern can be formed and then slid over the shaft. This approach can be used to retrofit existing oars with a flow disrupter pattern.

In particular embodiments, the flow disrupters, such as the bumps can be arranged along a plurality of line patterns, such as 120*a*, 120*b*, 120*c* and 120*d*, as shown in FIG. 4. In this example, the line pattern is a straight line. In other embodiments, the line pattern can vary. For example, an alternating line direction pattern can be used (e.g., see FIGS. 6A and 6B).

The line patterns can be distributed at different angles about the shaft, such as shaft 115 with a circular cross section. For example, line 120*a* can be placed at angle 112*a*, line 120*b* can be placed at angle 112*b*, line 120*c* can be placed at angle 112*c* and line 120*d* can be placed at angle 112*d*. In one embodiment, angles 112*b* and 112*c* can each have a magnitude of about sixty degrees and angles 112*a* and 112*d* can each have a magnitude of about ninety degrees.

In particular embodiments, angles 112*a* and 112*d* can be between about seventy five and one hundred and fifteen degrees. Further, angles 112*b* and 112*c* can be between about forty five and seventy five degrees. In one embodiment, angles 112*b* and 112*c* have a common magnitude. In another embodiment, angles 112*b* and 112*c* can have a different magnitude. Further, angles 112*a* and 112*d* can have a common magnitude or can have a different magnitude.

Figure 5:
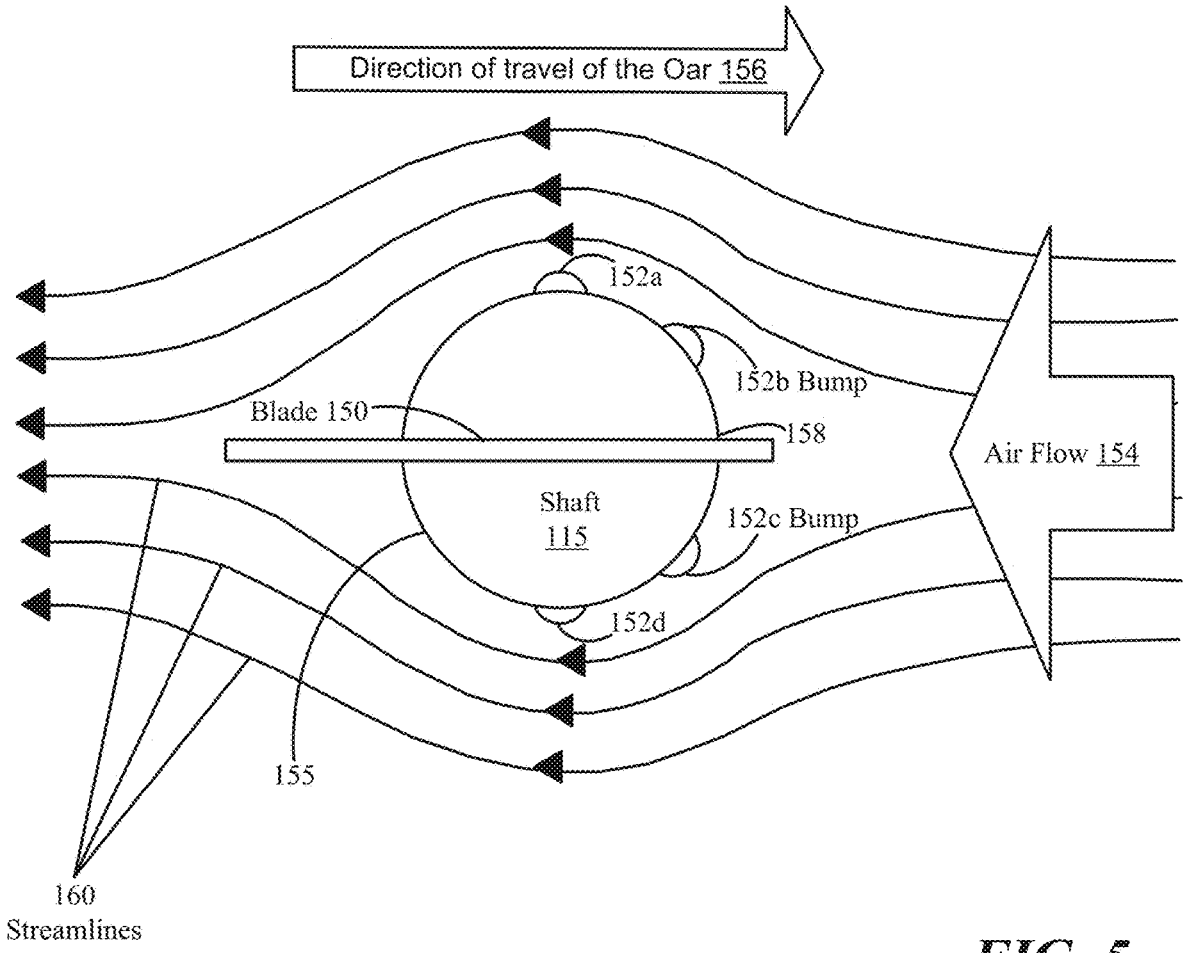

FIG. 5 is a cross sectional view of a shaft 115 of an oar including flow disrupters and an airflow pattern over the oar. The oar is traveling in the air during a recovery portion of the rowing stroke. The direction of travel of the oar is indicated by arrow 156. In this example, the oar is travelling approximately parallel to the water. The direction of the air flow 154 is indicated by the arrow.

As described above, the blade 150 can be feathered during the recovery portion of the stroke. Thus, the blade 150 is shown approximately parallel to the direction of the air flow 154. The blade 150 is show as a straight line. However, typically, the blade can have some curvature. Four bumps, 152*a*, 152*b*, 152*c* and 152*d* are shown. The bumps, 152*a*, 152*b*, 152*c* and 152*d* are arranged along lines as shown in FIG. 4.

When the shaft 115 is properly aligned, the air flow 154 impinges the shaft at location 158 and travels around either side of shaft 115. As described above, the oar travels in arc. Thus, the location 158 of impingement and the angle of the blade 150 relative to the air flow 154 can vary relative to what is shown in FIG. 5, i.e., the impingement location can be above or below location 158.

The air flow 154 is split as it travels around the shaft. The streamlines 160 show an example flow pattern. The bumps 152*a*, 152*b*, 152*c* and 152*d*, can cause the flow to transition to a more turbulent state. In the more turbulent state, the flow is better able to follow the shape of the shaft 115 on the backside 155 of the shaft without separating or at least delaying separation. This effect can reduce the aerodynamic drag on the shaft 115 and hence, reduce the energy needed to move it along the recovery portion of the stroke.

Figure 6A:
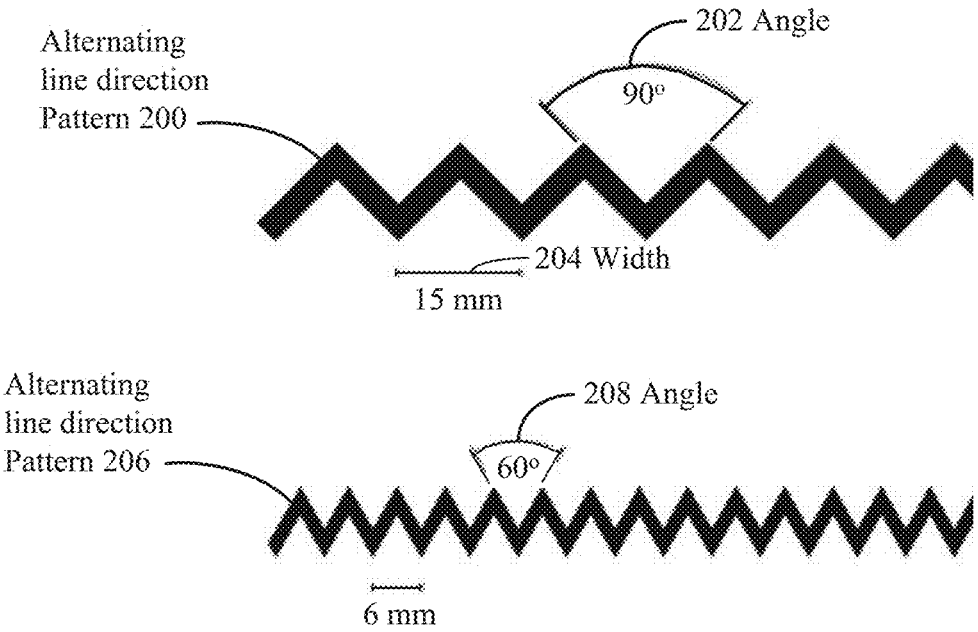
Figure 6B:
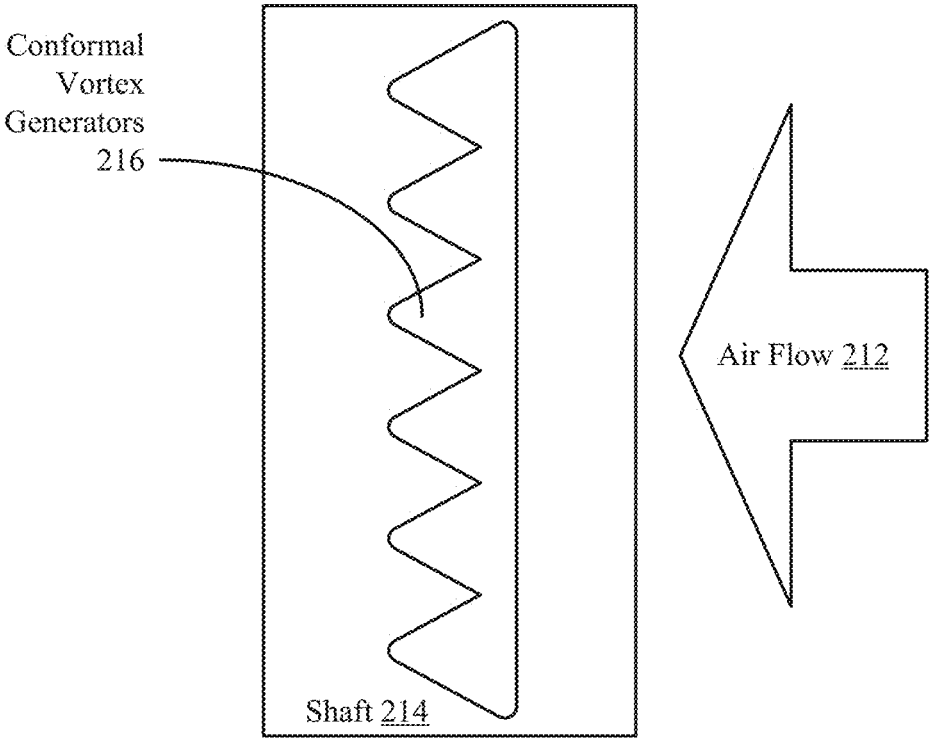

FIGS. 6A and 6B are top views of flow disrupters. In FIG. 6A, alternating line direction pattern 200 and alternating line direction pattern 206 are shown. The alternating line direction pattern can include pairs of lines arranged in a "V" pattern joined together. The height of the "V" and the angle between the lines forming the "V" can be varied. Thus, the alternating line direction pattern 200 includes an angle 202 and a width 204 between adjacent lines in the pattern. In alternating line direction pattern 200, the angle 202 is ninety degrees and the width 204 is fifteen millimeters. The alternating line direction pattern 206 uses an angle 208 of sixty degrees and has a width of six millimeters.

In one embodiment, the bumps, described above, can be arranged along an alternating line direction pattern. In another embodiment, the alternating line direction pattern can be formed as a continuous ridge. The ridge can have a constant height, such as one millimeter, or can have a varying height with peaks and valleys.

Again, the alternating line direction pattern can be integrally formed with the oar or the oar can be formed and then the pattern can be added to the oar. For example, the alternating line direction pattern 200 can be formed as a tape that is applied to the oar. As another example, the alternating line direction pattern 200 can be built into the oar when it is formed.

In FIG. 6B, vortex generators, such as conformal vortex generator 216, can be used on the shaft 214. A vortex generator can provide a ramp on the surface of the shaft that induces a vortex to form. For example, air flow 212 over the vortex generators, such as conformal vortex generators 216, can induce vortices to form. The vortices can add energy to the flow which can delay or prevent separation over the shaft. The delay or prevention of separation can reduce the aerodynamic drag over the shaft.

The vortex generators can be integrally formed with the oar or the oar can be formed and then the vortex generators can be added to the oar. For example, the conformal vortex generators 216 can be formed as a tape that is applied to the oar. As another example, the conformal vortex generators 216 can be built into the oar when it is formed.

Figure 7:
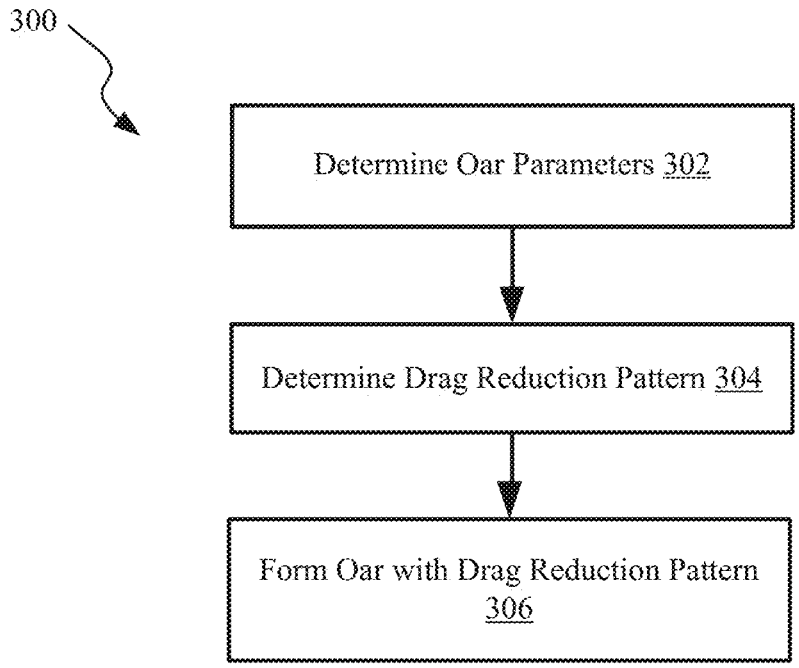

FIG. 7 is a method 300 of assembling an oar. In 302, oar parameters can be determined, such as a diameter of the oar for a circular shaft. The dimensions of the flow disrupters can depend on the oar parameters. For example, as the size of the oar increases, i.e., the diameter of the oar increases, the dimensions of the flow disrupters can increase.

In 304, a drag reduction pattern can be determined. The drag reduction pattern can include a plurality of flow disrupters, the dimensions of the flow disrupters, such as a height, shape, etc. and the pattern of the flow disrupters to be formed on the oar. The drag reduction pattern of the flow disrupters can include locations where the pattern is to be disposed. In 306, the oar can be formed with the drag reduction pattern specified in step 304.

The oar can be assembled by forming the shaft and handle of the oar where the shaft includes the flow disrupters. The blade can be formed separately from the shaft and the handle and then attached to the shaft. Alternately, the blade, shaft and handle can be integrally formed.

CONCLUSION

Different examples and aspects of the apparatus and methods are disclosed herein that include a variety of components, features, and functionality. In particular, apparatus and methods associated with a rowing oar are described. The rowing oar can be used with a boat in a sweep rowing configuration or a scull rowing configuration. It should be understood that the various examples and aspects of the apparatus and methods disclosed herein may include any of the components, features, and functionality of any of the other examples and aspects of the apparatus and methods disclosed herein in any combination, and all of such possibilities are intended to be within the spirit and scope of the present disclosure. Many modifications and other examples of the disclosure set forth herein will come to mind to one skilled in the art to which the disclosure pertains having the benefit of the teachings presented in the foregoing descriptions and the associated drawings.

What is claimed is:

1. An oar comprising:

a blade;

a shaft including a plurality of flow disrupters arranged around a perimeter of the shaft configured to reduce aerodynamic drag on the oar at least during a recovery phase of a rowing stroke, wherein an airflow impingement line faces a direction of movement of the oar during the recovery phase, the plurality of flow disrupters arranged such that air flow around the shaft enters a more turbulent state after coming in contact with the plurality of flow disruptors, wherein a cross section of the shaft is circular and wherein the plurality of flow disruptors are arranged in a first line, a second line, a third line and a fourth line along a length of the shaft, wherein a first angle between the first line and the second line is thirty degrees, a second angle between the second line and the third line is one hundred twenty degrees, and a third angle between the third line and the fourth line is thirty degrees, wherein the airflow impingement line is located sixty degrees from both the second line and the third line and ninety degrees from both the first line and the fourth line.

2. The oar of claim 1, wherein the plurality of flow disrupters are bumps.

3. The oar of claim 2, wherein a height of the bumps is between 0.25 and 1.5 mm.

4. The oar of claim 2, wherein a cross section of the bumps is circular.

5. The oar of claim 4, wherein a maximum diameter of the bumps is between three and fifteen mm.

6. The oar of claim 2, wherein the bumps are arranged in one or more lines along a surface of the shaft.

7. The oar of claim 6, wherein a spacing between the bumps in the one or more lines is between three mm and fifteen mm.

8. The oar of claim 2, wherein the bumps are formed on a tape, which is bonded to the shaft.

9. The oar of claim 1, wherein the perimeter of the shaft includes a first half and a second half and wherein the plurality of flow disrupters are disposed around the first half of the perimeter.

10. The oar of claim 1, wherein a length of oar is between two hundred to four hundred centimeters.

11. The oar of claim 1, wherein a cross section of the oar is circular and wherein a diameter of the oar is between two and seven centimeters.

12. The oar of claim 1, wherein the shaft of the oar is formed from a carbon composite material.

13. The oar of claim 1, wherein the plurality of flow disrupters are integrally formed with the shaft.

14. The oar of claim 1, wherein the shaft and the plurality of flow disrupters are formed separately and wherein the plurality of flow disrupters are bonded to the shaft.

15. The oar of claim 1 wherein the plurality of flow disrupters are formed as a set of ridges.

16. The oar of claim 15, wherein the set of ridges is arranged in an alternating line direction pattern.

17. The oar of claim 1, wherein plurality of flow disrupters are conformal vortex generators.

18. A rowing system comprising:

a boat;

a plurality of oars, each oar including:

a blade; and a shaft including a plurality of flow disrupters arranged around a perimeter of the shaft configured to reduce aerodynamic drag on the oar at least during a recovery phase of a rowing stroke, wherein an airflow impingement line faces a direction of movement of the oar during the recovery phase, the plurality of flow disrupters arranged such that air flow around the shaft enters a more turbulent state after coming in contact with the plurality of flow disruptors, wherein a cross section of the shaft is circular and wherein the plurality of flow disruptors are arranged in a first line, a second line, a third line and a fourth line along a length of the shaft, wherein a first angle between the first line and the second line is thirty degrees, a second angle between the second line and the third line is one hundred twenty degrees, and a third angle between the third line and the fourth line is thirty degrees, wherein the airflow impingement line is located sixty degrees from both the second line and the third line and ninety degrees from both the first line and the fourth line; and a mechanism for coupling each of the plurality of oars to the boat.

19. The rowing system of claim 18, wherein each oar is a sweep oar configured to be gripped with two hands.

20. The rowing system of claim 18, wherein each oar is a scull oar configured to be gripped with a single hand.

21. The rowing system of claim 18, wherein the boat includes seats for one, two, four, six or eight persons.

22. A method of manufacture comprising:

forming a blade of an oar;

forming a shaft and a handle of the oar wherein the shaft is formed with a plurality of flow disrupters arranged around a perimeter of the shaft configured to reduce aerodynamic drag on the oar at least during a recovery phase of a rowing stroke, wherein an airflow impingement line faces a direction of movement of the oar during the recovery phase, the plurality of flow disrupters arranged such that air flow around the shaft enters a more turbulent state after coming in contact with the plurality of flow disruptors, wherein a cross section of the shaft is circular and wherein the plurality of flow disruptors are arranged in a first line, a second line, a third line and a fourth line along a length of the shaft, wherein a first angle between the first line and the second line is thirty degrees, a second angle between the second line and the third line is one hundred twenty degrees, and a third angle between the third line and the fourth line is thirty degrees, wherein the airflow impingement line is located sixty degrees from both the second line and the third line and ninety degrees from both the first line and the fourth line; and coupling the blade to the shaft and the handle.

* * * * *